US005991982A

United States Patent [19]

Wakabayashi et al.

[11] Patent Number: 5,991,982

[45] Date of Patent: Nov. 30, 1999

[54] SLIDER FOR SLIDE FASTENER

[75] Inventors: Masao Wakabayashi; Kiyoshi Oda, both of Toyama-ken, Japan

[73] Assignee: YKK Corporation, Tokyo, Japan

[21] Appl. No.: 09/071,734

[22] Filed: May 1, 1998

[30] Foreign Application Priority Data

May 2, 1997 [JP] Japan ..... 9-114855

[51] Int. Cl.[6] ..... A44B 19/00

[52] U.S. Cl. ..... 24/429; 24/419; 24/437

[58] Field of Search ..... 24/429, 419, 437, 24/433, 370, 387; 294/3.6

[56] References Cited

U.S. PATENT DOCUMENTS 4,615,083 10/1986 Mayerhofer ..... 24/419
4,624,032 11/1986 Ishii et al. ..... 24/437
4,823,447 4/1989 Akashi ..... 24/429
4,829,638 5/1989 Ishii ..... 24/429
5,195,221 3/1993 Kanamaru et al. ..... 24/419
5,551,129 9/1996 Chu ..... 24/429

*Primary Examiner*—Victor N. Sakran
*Attorney, Agent, or Firm*—Hill & Simpson

[57] ABSTRACT

A slide fastener slider comprising: a slider body composed of upper and lower wings joined at their front ends by a guide post; a cantilevered attachment lug standing on an upper surface of the upper wing at its rear end and extending toward its front end; a pull tab having at one end an attaching ring adapted to be threaded on the attachment lug; a stop resiliently supported on the slider so as to normally come into contact with a front end of the attachment lug; and the guide post having in its upper surface a recess and defining between the recess and the front end of the attachment lug a gap that allows the attaching ring of the pull tab to pass through as pressing the stop away from the front end of the attachment lug.

7 Claims, 5 Drawing Sheets

SLIDER FOR SLIDE FASTENER

BACKGROUND OF THE INVENTION

1. Field of the Invention

This invention relates to a slide fastener slider of the type in which, after a slider body has been produced, a pull tab is attached to the slider so as to be free from being accidentally removed off the slider body.

2. Description of the Related Art

Many slide fastener sliders of the above-mentioned type are currently known. For example, Japanese Patent Publication No. Hei 1-14761 discloses a slider which has a cantilevered arch-shape attachment lug integrally standing on an upper wing of a slider body at its front end and extending toward its rear end for holding an axle of a pull tab between the attachment lug and the upper wing, a recess formed in the upper surface of the upper wing in confronting relation to the rear end of the attachment lug for passage of the attaching ring of the pull tab, and a resilient member supported by the slider body or the attachment lug for normally closing a gap between the upper wing and the rear end of the attachment lug. In production, for attaching the pull tab to the slider body, the axle of the pull tub is inserted through the gap as it deforms the resilient member closing the gap.

Japanese Patent Publication No. Hei 3-8761 discloses a slider which has a cantilevered arch-shape attachment lug integrally standing on an upper wing of a slider body at its front end and extending toward its rear end for holding an axle of a pull tab between the attachment lug and the upper wing, a gap defined between the rear end of the attaching lug and the upper wing, a gap-closing member slidably received in a longitudinal groove in the upper wing for movement between a closed position near the rear end of the attachment lug and an open position away from the rear end of the attachment lug, and a spring received in the longitudinal groove for normally urging the gap-closing member toward the closed position.

Republic of China Patent No. 272386 discloses a slider which has, as shown in FIG. 7 of the accompanying drawings, a cantilevered arch-shape attachment lug 9' standing integrally on an upper wing 3' of a slider body 1' at its rear end 11' and extending toward its front end 10' for holding an attaching ring of a pull tab (not illustrated) between the attachment lug 9' and the upper wing 3', a bottom-closed vertical groove 13' formed in the front surface of a guide post 13', a trapezoidal stop 18' vertically slidably received in the vertical groove 13', and a coil spring 20' disposed in the vertical groove 13' for normally urging the stop 18' upward against a lower surface 9*a*' of the front end of the attachment lug 9'. In production, after the stop 18' and the spring 20' have been inserted in the vertical groove 13', the front side of the vertical groove 13' is closed with a closure plate 21' to be fixed by clenching a pair of opposite side flanges F'. For attaching the pull tab to the attachment lug 9', the stop 18' is pushed downward away from the front end of the attachment lug 9' by the attaching ring of the pull tab so as to allow the attaching ring to pass through a gap 15' between the front end of the attachment lug 9' and the upper surface of the upper wing 3'.

However, in the slider disclosed in the first-named publication, partly since the pulling force of the pull tab acts directly on the resilient member and partly since the resilient member is supported by the attachment lug, a stable pull-tab-catching mechanism cannot be achieved. Further, since the gap between the rear end of the attachment lug and the upper surface of the slider body is substantially equal to the thickness of the axle of the pull tab, the axle pushes the resilient member from outside against the bias of the resilient member when the pull tab is pulled laterally in a horizontal posture and, as a result, the pull tab might inadvertently be removed off the slider body via the gap. And it is not possible to make the recess deeper so as to catch the resilient member well because the thickness of the upper wing at its rear end is particularly limited.

Also in the slider disclosed in the second-named publication, partly since the attachment lug stands on the upper surface of the upper wing at its front end and extends toward its rear end and partly since the gap-closing member is disposed at the rear end of the upper wing, a string pull-tab-catching mechanism cannot be achieved. Further, likewise the first-named publication, since the gap between the rear end of the attachment lug and the upper wing of the slider body is substantially equal to the thickness of the axle of the pull tab, the axle pushes the resilient member at its rear end portion from outside against the bias of the resilient member when the pull tab is pulled laterally in a horizontal posture and, as a result, the pull tab might inadvertently be removed off the slider body via the gap.

In the slider disclosed in the last-named publication (FIG. 7), the gap-closing mechanism is mounted in the guide post 5' at the front end of the slider body 1', which is successful in making the mechanism itself stronger. However, in this slider, likewise the previous sliders, the attaching ring of the pull tab pushes the stop 18' from outside against the resilience of the spring 20' when the pull tab is pulled laterally in a horizontal posture and, as a result, the pull tab might inadvertently be removed off the slider body 1' via the gap 15'. Further, since the stop 18' and the spring 20' are inserted into the guide post 5' from its front side, this slider is not suitable to automated assembling.

SUMMARY OF THE INVENTION

It is therefore a primary object of this invention to provide a slide fastener slider in which a pull tab can be attached to an attachment lug simply and stably after all the other members of the slider are assembled and can be prevented from being inadvertently removed off the attachment lug when it is pulled in any posture, and which is suitable to automated assembling.

A second object of the invention is to provide a slide fastener slider in which an attaching ring of the pull tab can be threaded on the attachment lug simply and smoothly and can be caught by the attachment lug reliably.

A third object of the invention is to provide a slide fastener slider in which the relation between the attachment lug and a gap through which the pull tab is to be threaded onto the attachment lug is specified so that the pull tab can be prevented from being inadvertently removed off the attachment lug when it is pulled in any posture.

A fourth object of the invention is to provide a slide fastener slider in which the relation between the attaching ring of the pull tab and a stop is specified so that the pull tab can be prevented from being inadvertently removed off the attachment lug when it is pulled in any posture.

A fifth object of the invention is to provide a slide fastener slider in which a stable gap closing mechanism is mounted in a guide post of the slider body so as not to be seen from outside, thus giving a neat overall appearance, and which is suitable to automated assembling.

A sixth object of the invention is to provide a slide fastener slider which the gap closing mechanism is made of thermoplastic resin and is therefore suitable to a slider molded of thermoplastic resin.

A seventh object of the invention is to provide a slide fastener slider in which a stable gap closing mechanism is mounted in an upper wing of the slider body so as not to be seen from outside, thus giving a neat overall appearance, and which is suitable to automated assembling.

According to a first aspect of the invention, there is provided a slide fastener slider comprising a slider body, an attachment lug, a pull tab and a stop as follows. The slider body is composed of upper and lower wings joined together at their front ends by a guide post. The attachment lug has a cantilevered shape and is standing on an upper surface of the upper wing at its rear end and extending toward its front end. The pull tab has at one end an attaching ring which is adapted to be threaded on the attachment lug. The stop is resiliently supported on the slider so as to normally come into contact with a front end of the attachment lug. The slider is characterized in that the guide post in the front of the slider body has in its upper surface a recess and defines a gap between the recess and the front end of the attachment lug. The gap allows the attaching ring of the pull tab to pass through as the attaching ring pressing the stop away from the front end of the attachment lug.

According to a second aspect of the invention, the recess in the upper surface of the guide post has a contour that is substantially analogous to the outer shape of the attaching ring of the pull tab.

According to a third aspect of the invention, a distance between a lower surface of the front end of the attachment lug and a horizontal plane including the upper surface of the upper wing is smaller than the thickness of the attaching ring of the pull tab when the pull tab is threaded on and held in place with respect to the attachment lug.

According to a fourth aspect of the invention, the central point of the attaching ring of the pull tab positions forward of a plane including a rear surface of the stop when the pull tab is threaded on the attachment lug and horizontally held in such a place that an outer circumferential edge of the attaching ring comes into contact with the attachment lug and an inner circumferential edge of the attaching ring comes into contact with the stop.

According to a fifth aspect of the invention, the guide post has a vertical through-hole in which the stop is vertically slidably received. Further, the slider includes a support plate which is fixed to the lower wing at a lower end of the vertical through-hole and a spring which is disposed in the through-hole between the support plate and the stop for normally urging the latter upward. The stop has on its upper end surface a slope which is sloping down forward.

According to a sixth aspect of the invention, the stop, the support plate and the spring are integrally molded of thermoplastic resin.

According to a seventh aspect of the invention, the upper wing has a bottomed horizontal hole extending from its front end toward and terminating short of its rear end, the stop being horizontally slidably received in the horizontal hole, the slider further including a spring disposed between a bottom of the horizontal hole and the stop for normally urging the stop against a rear surface of the front end of the attachment lug.

DETAILED DESCRIPTION OF THE PREFERRED EMBODIMENTS

Various preferred embodiments of this invention will now be described in detail with reference to the accompanying drawings.

Figure 1:
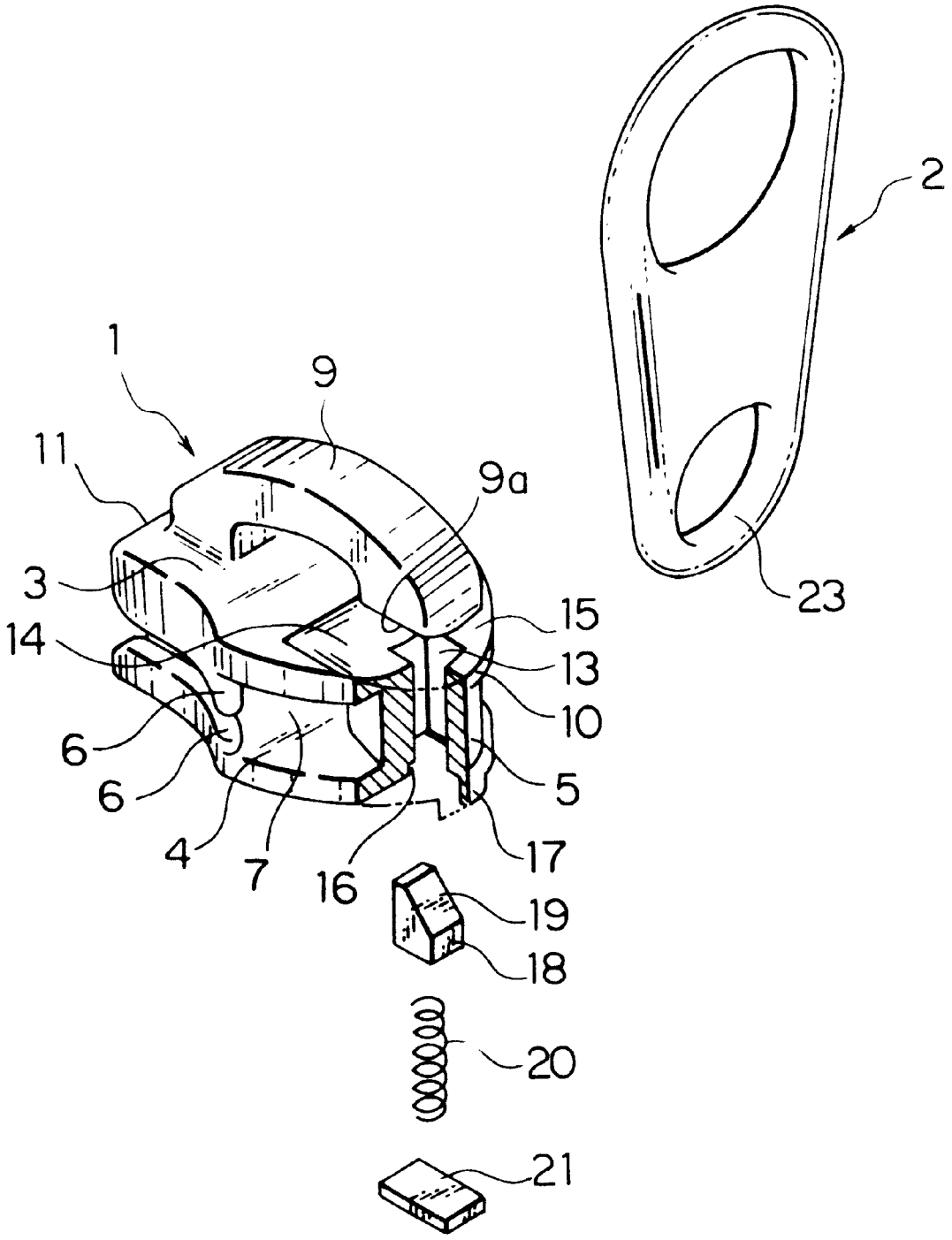
FIG. 1 is an exploded perspective view, with parts broken away, of a slide fastener slider according to a first embodiment of this invention.

FIG. 1 shows a slide fastener slider according to a first embodiment. In this slider, a slider body 1 is composed of upper and lower wings 3, 4 joined at their front ends by a guide post 5 and each having a pair of guide flanges 6 bent from opposite side edges, thereby defining between the upper and lower wings 3, 4 a fastener-element guide channel 7 for passage of a pair of fastener elements (not shown). Alternatively only one of the upper and lower wings 3, 4 may have a pair of guide flanges 6.

On the upper wing 3 of the slider body 1, a cantilevered arch-shape attachment lug 9 stands at its rear end 11 and extends toward its front end 10. The attachment lug 9 terminates short of the upper surface of the guide post 5. The guide post 5 has a through-hole 13 extending vertically and a recess 14 disposed at its upper end. The recess 14 has an arcuate bottom surface extending to such a wide range so as to cover the lower surface 9*a* of the front end of the attachment lug 9 and defining with the lower surface 9*a* a gap 15, as shown in FIG. 3.

Figure 3:
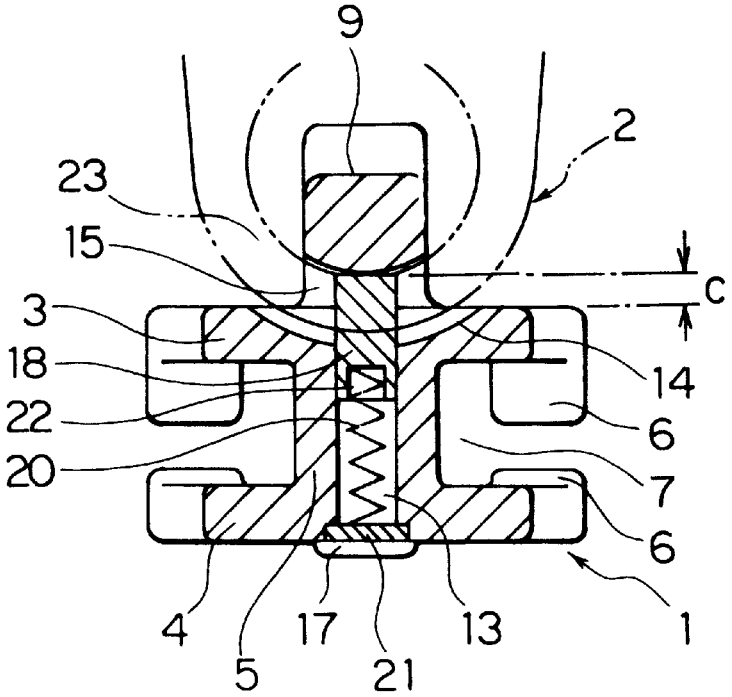
FIG. 3 is a transverse cross-sectional view of the slider of the first embodiment.

The gap 15 is substantially analogous in contour to the attaching ring 23 of the pull tab 2 so that the attaching ring 23 can be threaded onto the attaching lug 9 via the gap 15, as shown in FIG. 3. On the other hand, the distance C between the horizontal plane including the upper surface of the upper wing 3 and the lower surface 9*a* of the front end of the attachment lug 9 is smaller than the thickness of the attaching ring 23 of the pull tab 2 so that the attaching ring 23 comes into contact with a rear surface of the attaching lug 9 rather than with a stop (described below) 18 when the pull tab 2 is pulled toward the front end 10.

Figure 2:
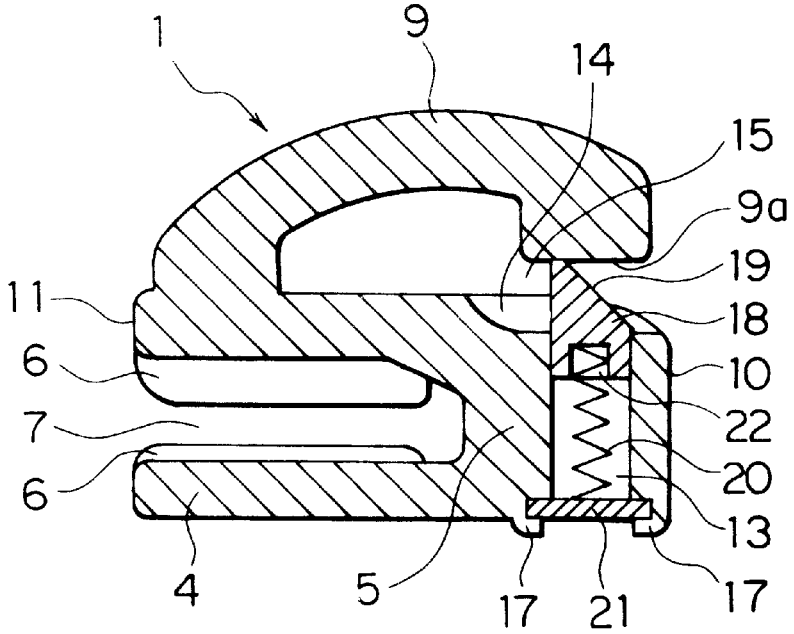
FIG. 2 is a fragmentary longitudinal cross-sectional view of the slider of the first embodiment.

The guide post 5 has at the lower end of the vertical through-hole 13 a stepped portion 16 and front and rear projections 17. A support plate 21 is fitted in the stepped portion 16 and is fixed to the guide post 5 by clenching the front and rear projections 17, as shown in FIG. 2. The stop 18, which has a trapezoidal shape and has on its upper surface a slope 19 sloping down to the front side, is vertically slidably inserted in the vertical through-hole 13. A coil spring 20 is inserted in the vertical through-hole 13 with its upper end fixedly fitted in a hole 22 (see FIG. 2) in a lower surface of the stop 18 and with its lower end resiliently contacting the support plate 21. Alternatively, the support plate 21 may has on its upper surface a pin to be fitted in the lower end of the coil spring 20.

The top end of the stopper 18 inserted in the through-hole 13 is normally urging the lower surface 9*a* of the front end of the attachment lug 9 upward. It is pushed downward away from the lower end of the attachment lug 9 and retracted in the slider body 1 against the resilience of the spring 20 by the attaching ring 23, when the attaching ring 23 is threaded onto the attachment lug 9 via the gap 15.

Figure 4:
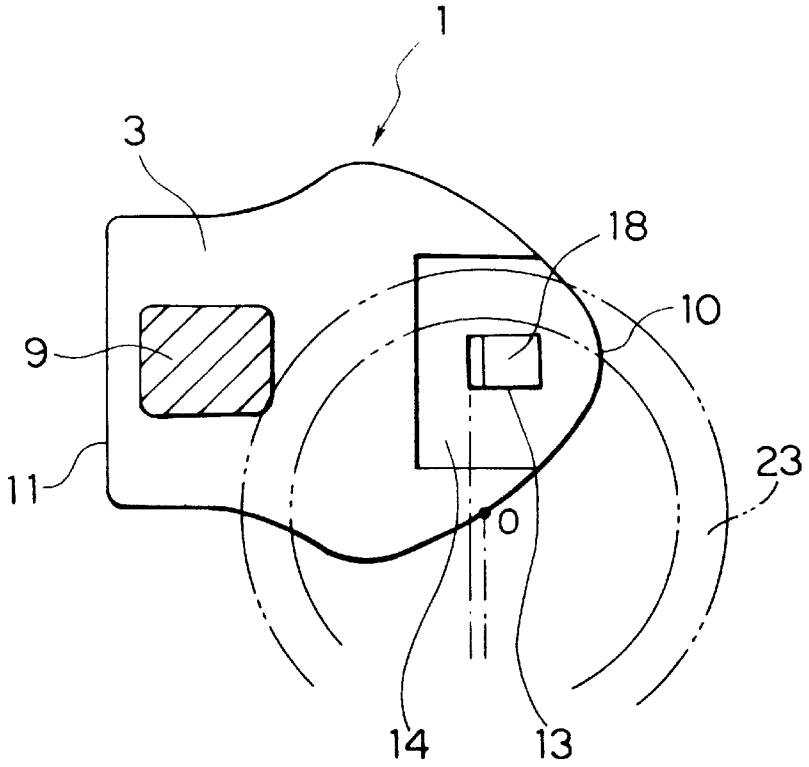
FIG. 4 is a plan view, with parts broken away, of the slider of the first embodiment.

When the attaching ring 23 is threaded on the attaching lug 9 and laid horizontally on the upper wing 3 in such a place that an outer circumferential edge of the attaching ring 23 contacts the rear end of the attachment lug 9 and an inner circumferential edge of the attaching ring 23 contacts the stop 18 as shown in FIG. 4, the central point of the attaching ring 23 positions forward of a plane including the rear surface of the stop 18. With this arrangement, after having been attached to the attachment lug 9, the pull tab 2 can be prevented from being inadvertently removed off the attachment lug 9.

In production, the slider body 1 and the stopper 18 are molded of metal, such as aluminum alloy or zinc alloy, by die casting and then assembled together with the coil spring 20 and the support plate 21, which are made of metal, by an automated assembling process. This slider is suitable for automated assembling; because the stop 18, the spring 20 and the support plate 21 can be provided to the slider body 1 from a single side of the slider body 1, and subsequently, the support plate 21 can be secured to the lower wing 4 by clenching the front and rear projections 17 from the same side of the slider body 1.

Figure 5:
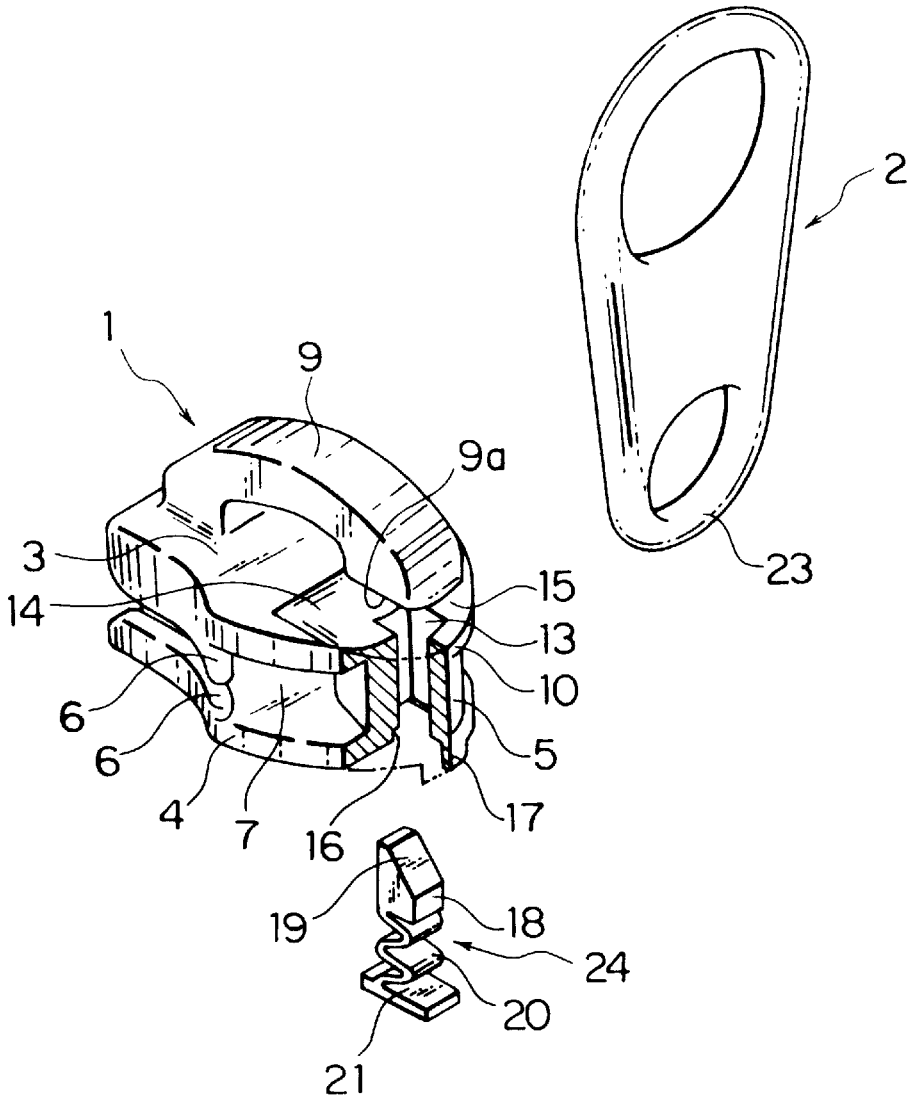
FIG. 5 is an exploded perspective view, with parts broken away, of a slide fastener slider according to a second embodiment of the invention.

FIG. 5 shows a slide fastener slider according to a second embodiment in which a slider body 1, a pull tab 2, a stop 18, a spring 20 and a support plate 21 are all molded of thermoplastic resin, such as polyamide, polyacetal, polypropylene or polybutylene-terephthalate, by injection molding or extrusion molding and are then assembled together.

The slider of the second embodiment is identical with that of the first embodiment except that the stop 18, the spring 20 and the support plate 21 are molded as a unitary hole-closing member 24 in which the spring 20 is in the form of a single meandering sheet. Alternatively, the spring 20 may be in the form of a pair of juxtaposed meandering sheets. In production, the molded hole-closing member 24 is inserted into the vertical through-hole 13 of the guide post 5 of the slider body 1, whereupon the support plate 21 is welded with front and rear projections 17 of the lower wing 4 by an ultrasonic welder.

Figure 6:
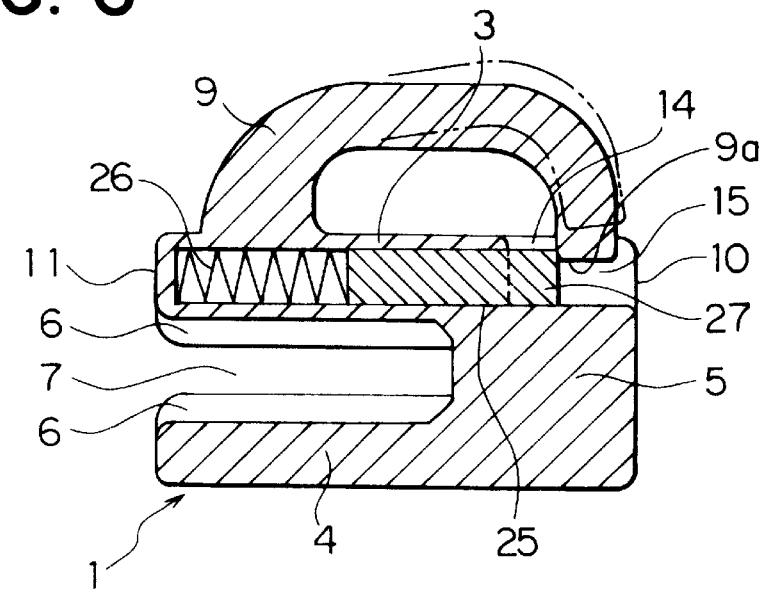
FIG. 6 is a fragmentary longitudinal cross-sectional view of a slide fastener slider according to a third embodiment of the invention.
Figure 7:
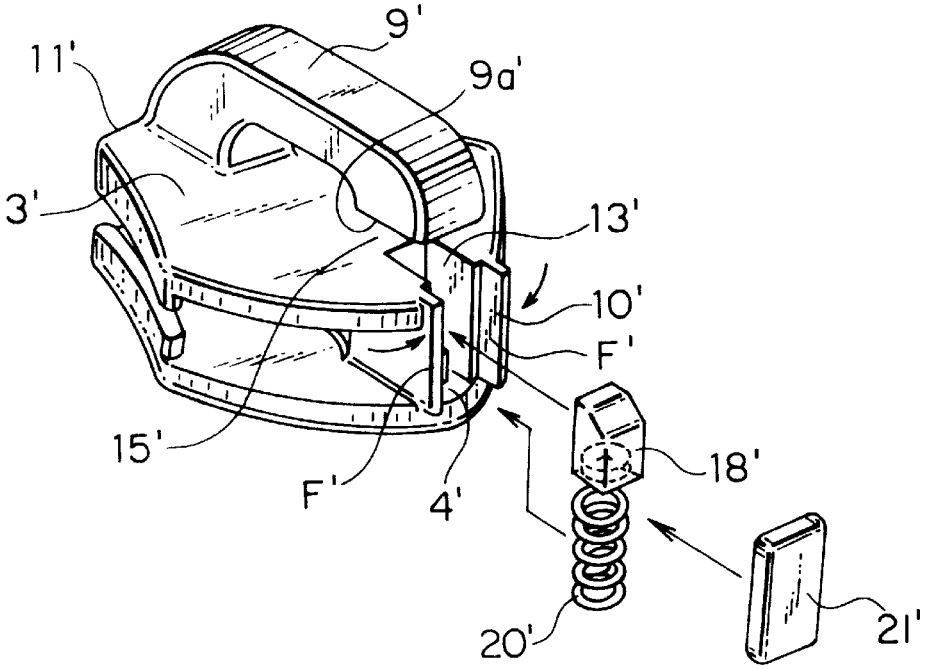
FIG. 7 PRIOR ART
FIG. 7 is a fragmentary exploded perspective view of a conventional slide fastener slider.

FIG. 6 shows a slide fastener slider according to a third embodiment. In this embodiment, like the first embodiment, a slider body 1 is composed of upper and lower wings 3, 4 joined together at their front ends by a guide post 5 and each having a pair of guide flanges 6 bent from opposite side edges, thereby defining between the upper and lower wings 3, 4 a fastener-element guide channel 7. On the upper wing 3 of the slider body 1, a cantilevered arch-shape attachment lug 9 stands at its rear end 11 and extends toward its front end 10.

The upper wing 3 has a bottomed horizontal hole 25 extending from its front end 10 toward and terminating short of its rear end 11 and a recess 14 disposed at the front end of the horizontal hole 25 and having an arcuate bottom surface downward of the lower surface 9*a* of the front end of the attachment lug 9.

An rectangular stop 27 is horizontally slidably received in the horizontal hole 25, and a coil spring 26 is disposed between the bottom (rear end) of the horizontal hole 25. After having been molded, the front end of the attachment lug 9 is deformed downward into the recess 14 by cold pressing. Because of this arrangement, the stop 27 in the horizontal hole 25 is pushed against the rear surface of the front end of the attachment lug 9 under the resilience of the spring 26; thus the stop 27 is prevented from removing off the horizontal hole 25. The deformed front end of the attachment lug 9 defines between the lower surface 9*a* of the front end of the attachment lug 9 and a bottom surface of the recess 14 a gap 15 for the passage of the attaching ring 23 of the pull tab 2.

For attaching the pull tab 2 to the attachment lug 9, the stop 27 is pushed away from the rear surface of the lower end of the attachment lug 9 against the resilience of the spring 26 by the attaching ring 23, and then the attaching ring 23 is threaded onto the attachment lug 9 via the gap 15.

After having thus been attached to the attachment lug 9, the pull tab 2 is perfectly prevented from being inadvertently removed off the attachment lug 9. This slider of the third embodiment also is suitable to automated assembling like the foregoing embodiments.

In the production of slide fasteners, the individual pull tab 2 may be attached to the corresponding attachment lug 9 before or after the slider is threaded on a pair of opposed fastener stringers. If it has once been attached to the slider body 1, then the pull tab 2 is semi-permanently free from accidental removal.

The slider of this invention brings about the following advantageous results:

According to the first aspect of the invention, partly since a cantilevered arch-shape attachment lug 9 stands on the upper surface of the upper wing 3 at its rear end 11 and extends toward its front end 10, partly since a stop 18 is resiliently projecting on the upper surface of the guide post 5 so as to normally push the front end of the attachment lug 9 and partly since the guide post 5 has in its upper surface a recess 14 through which the attaching ring 23 of the pull tab 2 is threaded onto the attachment lug 9, it is possible to attach the pull tab 2 to an attachment lug 9 simply and stably after all the members other than the pull tub 2 are assembled and to prevent the pull tab 2 from being inadvertently removed off the attachment lug 9 when it is pulled in any posture. Further, it is possible to allow an increased degree of freedom in depth of the recess 14, as compared with a conventional slider in which the recess is formed, not on the guide post at the front end of the slider, but at the rear end of the upper wing.

According to the second aspect of the invention, since the recess 14 is substantially analogous in contour to the attaching ring 23 of the pull tab 2, it is possible to thread the attaching ring 23 of the pull tab 2 onto the attachment lug 9 simply and smoothly and to catch the attaching ring 23 by the attachment lug 9 reliably.

According to the third aspect of the invention, since the distance between the lower surface 9*a* of the front end of the attachment lug 9 and a horizontal plane including the upper surface of the upper wing 3 is smaller than the thickness of the attaching ring 23 of the pull tab 2 when the pull tab 2 is threaded on and held in place with respect to the attachment lug 9, it is possible to keep the stop 18 free from being pushed away from the front end of the attachment lug 9 to open the gap 15 by the attaching ring 23 from outside so that pull tab 2 can be prevented from being inadvertently removed off the attachment lug 9 when it is pulled in any posture.

According to the fourth aspect of the invention, since the central point of the attaching ring 23 of the pull tab 2 positions forward of a plane including a rear surface of the stop 18, 27, when the pull tab 2 is threaded on the attachment lug 9 and laid horizontally on the upper wing 3 in such a place that an outer circumferential edge of the attaching ring 2 contacts the attachment lug and an inner circumferential edge of the attaching ring 23 contacts the stop 18, it is possible to keep the stop 18, 27 free from being pushed away from the front end of the attachment lug 9 to open the gap 15 by the attaching ring 23 from outside so that pull tab 2 can be prevented from being inadvertently removed off the attachment lug 9 when it is pulled in any posture.

According to the fifth aspect of the invention, partly since the guide post 5 has a vertical through-hole 13 in which the stop 18 is vertically slidably received with its lower end supported by a support plate 21 fixed to the lower end of the vertical through-hole 13, partly since a spring 20 is disposed in the through-hole 13 between the support plate 21 and the stop 18 for normally urging the latter upward, and partly since the stop 18 has on its upper surface a slope 19 sloping down forward, it is possible to mount a stable gap closing mechanism in the guide post 5 so as not to be seen from outside, thus giving a neat overall appearance to the slider. Also this slide fastener slider is suitable to automated assembling.

According to the sixth aspect of the invention, since the stop 18, the support plate 21 and the spring 20 are integrally molded of thermoplastic resin, it is possible to mold the gap closing mechanism of thermoplastic resin simply and hence to make it suitable to a slider molded of thermoplastic resin.

According to the seventh aspect of the invention, partly since the upper wing 3 has a bottomed horizontal hole 25 extending from its front end 10 toward and terminating short of its rear end 11, and partly since the stop 27 is horizontally slidably received in the horizontal hole 25 with a spring 26 disposed between a bottom of the horizontal hole 25 and the stop 27 for normally urging the stop 27 against a rear surface of the front end of the attachment lug 9, it is possible to mount a stable gap closing mechanism in the upper wing 3 as not to be seen from outside, thus giving a neat overall appearance to the slider and making it particularly suitable to automated assembling. Therefore an improved rate of production can be realized.

What is claimed is:

1. A slide fastener slider comprising:

(a) a slider body composed of upper and lower wings joined at their front ends by a guide post;

(b) a cantilevered attachment lug standing on an upper surface of said upper wing at its rear end and extending toward its front end;

(c) a pull tab having at one end an attaching ring adapted to be threaded on said attachment lug;

(d) a stop resiliently supported on said slider so as to normally come into contact with a front end of said attachment lug; and (e) said guide post having in its upper surface a recess extending rearward from an outer front edge of the guide post and defining between said recess and said front end of said attachment lug a gap that allows said attaching ring of said pull tab to pass through as pressing said stop away from said front end of said attachment lug.

2. A slide fastener slider according to claim 1, wherein said recess has a contour that is substantially analogous to the outer shape of said attaching ring of said pull tab.

3. A slide fastener slider according to claim 1, wherein a distance between a lower surface of said front end of said attachment lug and a horizontal plane including said upper surface of said upper wing is smaller than the thickness of said attaching ring of said pull tab when said pull tab is threaded on and held in place with respect to said attachment lug.

4. A slide fastener slider according to claim 1, wherein the central point of said attaching ring of said pull tab positions forward of a plane including a rear surface of said stop when said pull tab is threaded on said attachment lug and laid horizontally on said upper wing in such a place that an outer circumferential edge of the attaching ring contacts said attachment lug and an inner circumferential edge of the attaching ring contacts said stop.

5. A slide fastener slider according to claim 1, wherein said guide post has a vertical through-hole in which said stop is vertically slidably received, said slider further including a support plate fixed to said lower wing at a lower end of said vertical through-hole and a spring disposed in said through-hole between said support plate and said stop for normally urging the latter upward, said stop having on its upper end surface a slope which is sloping down forward.

6. A slide fastener slider according to claim 5, wherein said stop, said support plate and said spring are integrally molded of thermoplastic resin.

7. A slide fastener slider according to claim 1, wherein said upper wing has a bottomed horizontal hole extending from its front end toward and terminating short of its rear end, said stop being horizontally slidably received in said horizontal hole, said slider further including a spring disposed between a bottom of said horizontal hole and said stop for normally urging said stop against a rear surface of said front end of said attachment lug.

* * * * *

UNITED STATES PATENT AND TRADEMARK OFFICE

CERTIFICATE OF CORRECTION

PATENT NO. : 5,991,982
DATED : November 30, 1999
INVENTOR(S) : Masao Wakabayashi; Kiyoshi Oda and Hideyuki Matsushima It is certified that error appears in the above-identified patent and that said Letters Patent is hereby corrected as shown below:

Title page,
Item [75], Inventors, after "Kiyoshi Oda," insert
-- Hideyuki Matsushima, [both] all --

Signed and Sealed this

Twenty-fifth Day of December, 2001

*Attest:*

*Attesting Officer*

JAMES E. ROGAN
*Director of the United States Patent and Trademark Office*